US009676590B1

(12) United States Patent
Berry

(10) Patent No.: US 9,676,590 B1
(45) Date of Patent: Jun. 13, 2017

(54) AXIALLY-ADJUSTABLE WINDER FOR FLAT-WEB, STRAND, HOSE, ROPE, ELECTRIC CORD OR STRINGS OF HOLIDAY LIGHTS AND SO ON

(71) Applicant: Kevin D. Berry, West Plains, MO (US)

(72) Inventor: Kevin D. Berry, West Plains, MO (US)

( * ) Notice: Subject to any disclaimer, the term of this patent is extended or adjusted under 35 U.S.C. 154(b) by 83 days.

(21) Appl. No.: 14/862,693

(22) Filed: Sep. 23, 2015

Related U.S. Application Data

(60) Provisional application No. 62/053,865, filed on Sep. 23, 2014.

(51) Int. Cl.

| | |
|---|---|
| ***B65H 75/24*** | (2006.01) |
| ***B65H 75/22*** | (2006.01) |
| ***B65H 75/28*** | (2006.01) |
| ***B65H 75/30*** | (2006.01) |

(52) U.S. Cl.
CPC ..... *B65H 75/241* (2013.01); *B65H 75/22* (2013.01); *B65H 75/28* (2013.01); *B65H 75/30* (2013.01); *B65H 2301/4132* (2013.01); *B65H 2701/33* (2013.01); *B65H 2701/34* (2013.01); *B65H 2701/35* (2013.01); *B65H 2701/36* (2013.01); *B65H 2701/375* (2013.01); *B65H 2701/50* (2013.01)

(58) Field of Classification Search
CPC ..... B65H 75/22; B65H 75/24; B65H 75/241; B65H 75/28; B65H 75/30
USPC ..... 242/578–578.3
See application file for complete search history.

(56) References Cited

U.S. PATENT DOCUMENTS

| | | | | |
|---|---|---|---|---|
| 550,701 A | | 12/1895 | Wardwell, Jr. | 112/232 |
| 1,831,848 A | | 11/1931 | Doney et al. | 242/574 |
| 2,112,606 A | | 3/1938 | Pless | 242/578.2 |
| 2,619,300 A | * | 11/1952 | Bartholy | G03D 13/147 242/578.2 |
| 2,663,509 A | | 12/1953 | Hinchman | 242/597.3 |
| 3,680,807 A | * | 8/1972 | Fortson | B21C 47/28 242/118.62 |
| 3,829,034 A | | 8/1974 | Mickelson | 242/597.3 |
| 4,193,560 A | | 3/1980 | Diegel | 242/578.2 |
| 4,240,867 A | | 12/1980 | Diegel | 156/543 |

(Continued)

OTHER PUBLICATIONS

Ratchet Strap Winder at www.rhaonline.co.uk/vehicle-security-safety/ext-105-ratchet-strap-winde_-.html Accessed on Sep. 22, 2014.

*Primary Examiner* — William E Dondero
(74) *Attorney, Agent, or Firm* — Jonathan A. Bay

(57) ABSTRACT

A winding device has an axially-adjustable spindle assembly for winding a variety of elongated flexible materials into windings or spiral coils, including without limitation flat-web, garden hose, strand, twined, braided or woven rope or the like, electric cord or even strings of holiday lights and so on. The winding device comprises a pair of side frames, one which is driven in revolutions and the other which is generally stationary. The side frames have inboard surfaces facing each other and outboard surfaces facing away. One side frame has a hollow tubular sleeve extending away from about the center of its inboard surface while the other side frame has a cylindrical spindle stub extending away from about the center of its respective inboard surface. The spindle stub telescopes into the tubular sleeve such that the side frames can revolve/rotate relative each other, close the gap between each other, or pull apart.

20 Claims, 13 Drawing Sheets

(56) References Cited

U.S. PATENT DOCUMENTS

| | | | | |
|---|---|---|---|---|
| 5,495,996 | A | 3/1996 | Sakamoto et al. | 242/402 |
| 5,551,647 | A * | 9/1996 | Browning | B65H 49/305 242/118.5 |
| 6,908,060 | B2 | 6/2005 | Hibbs | 242/578.2 |
| 7,766,271 | B1 | 8/2010 | Confoey | 242/395 |
| 2004/0056141 | A1 | 3/2004 | Quick | 242/578 |
| 2009/0194628 | A1 | 8/2009 | Taylor | 242/395 |
| 2011/0041458 | A1* | 2/2011 | Yu Chen | B65B 67/085 53/389.4 |
| 2011/0042504 | A1* | 2/2011 | Yu Chen | B65H 75/241 242/578.2 |
| 2011/0049287 | A1* | 3/2011 | Yu Chen | B65H 75/241 242/578.2 |
| 2011/0309182 | A1 | 12/2011 | Franchini | 242/403.1 |
| 2012/0104145 | A1* | 5/2012 | Dagley | B65H 75/22 242/607.1 |
| 2013/0119181 | A1* | 5/2013 | Fan | B65H 75/241 242/400.1 |

* cited by examiner

AXIALLY-ADJUSTABLE WINDER FOR FLAT-WEB, STRAND, HOSE, ROPE, ELECTRIC CORD OR STRINGS OF HOLIDAY LIGHTS AND SO ON

CROSS-REFERENCE TO PROVISIONAL APPLICATION(S)

This application claims the benefit of U.S. Provisional Application No. 62/053,865 filed Sep. 23, 2014, the disclosure of which is incorporated herein by this reference thereto.

BACKGROUND AND SUMMARY OF THE INVENTION

The invention relates to winding apparatus and, more particularly, to winding apparatus with an axially-adjustable spindle assembly for winding a variety of elongated flexible materials, including without limitation flat-web, strand, hose, twined or braided or woven rope, electric cord or strings of holiday lights and so on.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings, FIG. 1 is a perspective view of winding apparatus in accordance with the invention for winding a variety of elongated flexible materials, including without limitation flat-web, garden hose, strand, twined or braided or woven rope, electric cord or strings of holiday lights and so on;

DETAILED DESCRIPTION OF THE PREFERRED EMBODIMENTS

Figure 1:
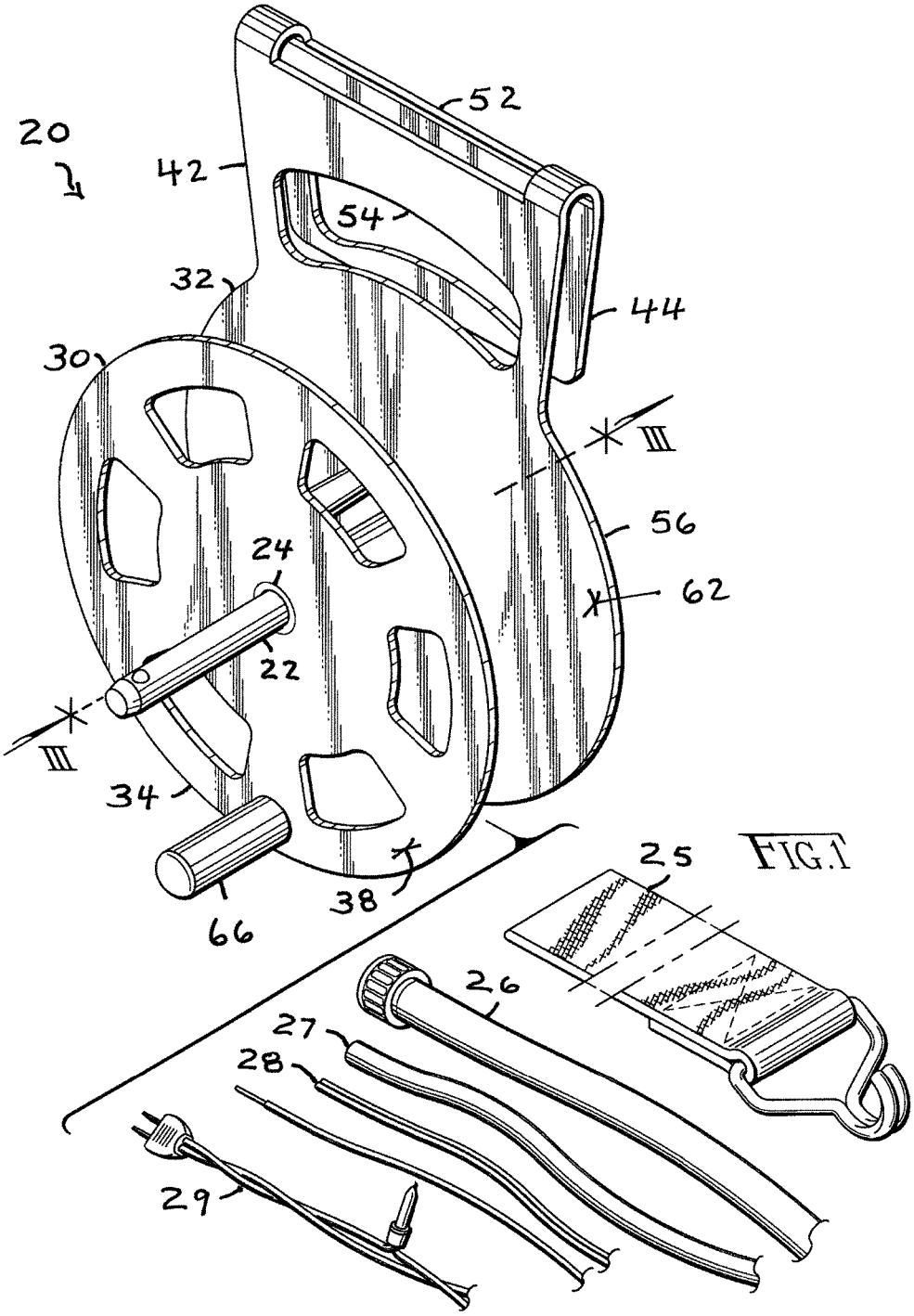

FIGS. 1-4 and 6 show a winding apparatus 20 in accordance with the invention. It has an axially-adjustable spindle assembly 22,24 for winding a variety of elongated flexible materials, including without limitation flat-web 25, garden hose 26, strand, twined or braided or woven rope 27, electric cord 28 or strings of holiday lights 29 and so on.

The winding apparatus 20 comprises a pair of side frames 30 and 32, namely, a revolving side frame 30 which slides apart from a non-revolving side frame 32. The revolving side frame 30 is preferably the driven side frame, albeit manually driven in this example. Whereas the drawings show a manually operated reel, said winding apparatus 20 could readily be adapted for being power driven by a motor (not shown), which would be especially desirable when produced on an enlarged scale. The non-revolving side frame 32 is the relative stationary side frame of the two.

Figure 4:
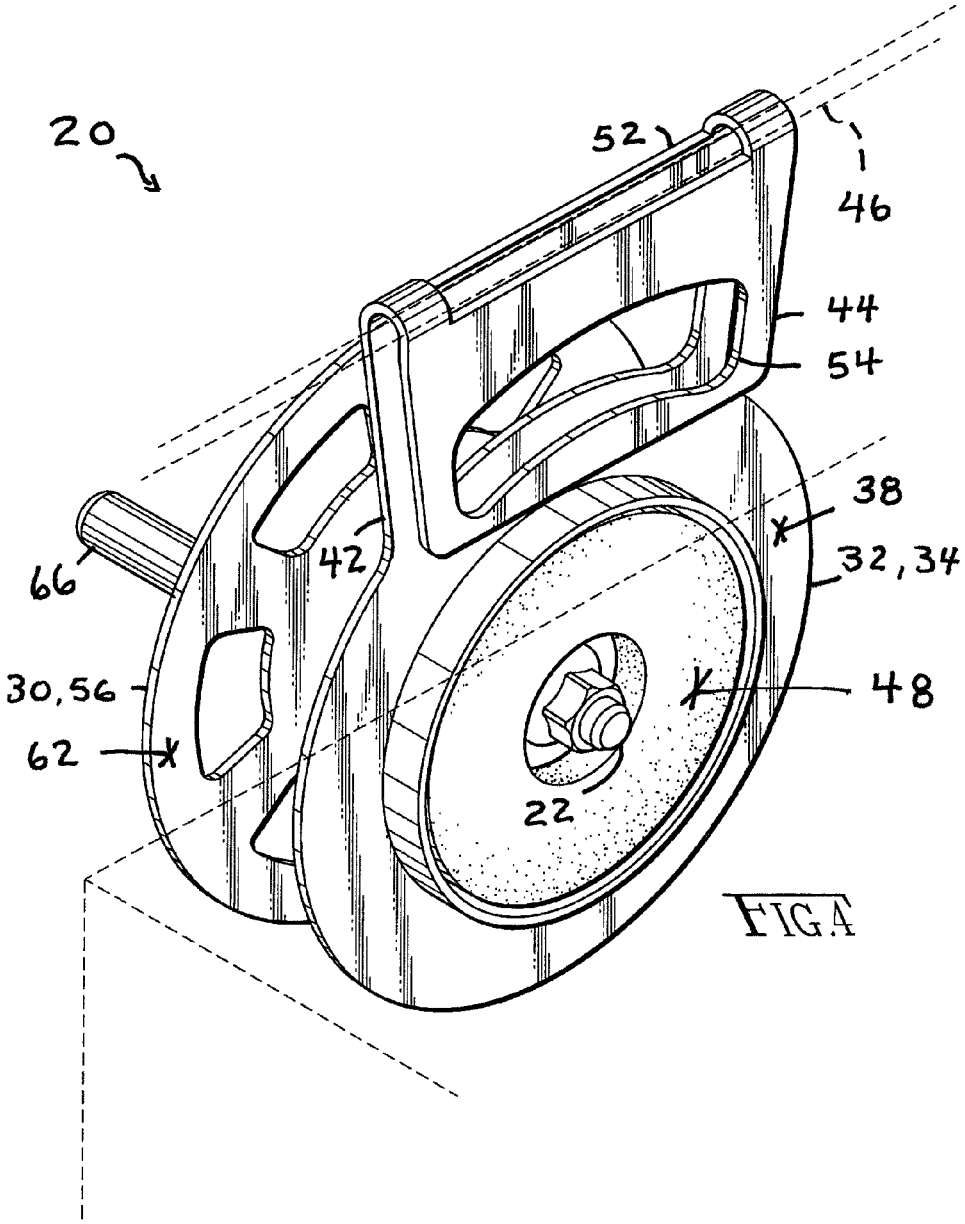
FIG. 4 is a perspective view comparable to FIG. 1 except showing better the outboard features of the non-revolving side frame.

The relatively stationary (eg., non-revolving) side frame 32 comprise a relatively planar main disk portion 34, preferably produced of plate steel, having inboard and outboard surfaces 36 and 38. The stationary side frame 32 furthermore has a handle protrusion 42 protruding beyond the diameter of the rest of the periphery of the main disk portion 34. The handle protrusion 42 is folded back onto itself toward the outboard surface 38 of the main disk portion 34 to form a hook formation 44. FIG. 4 shows better that the hook formation 44 serves to hook the stationary side frame 32 over a side panel 46 of a utility truck or the like. The stationary side frame 32 also has a strong magnet 48 attached to outboard surface 38 of the main disk portion 34 for securing the stationary side frame 32 to metal (eg., ferromagnetic metal) panels 46 such as those of a utility truck or the like. The magnet 48 and hook formation 44 might be used together for securing the stationary side frame 32, or independently. Additionally, the stationary side frame 32 can simply be held by a user in one hand by means of the handle protrusion 42 being formed in a handle formation 52 including a fingers aperture 54.

Figure 2:
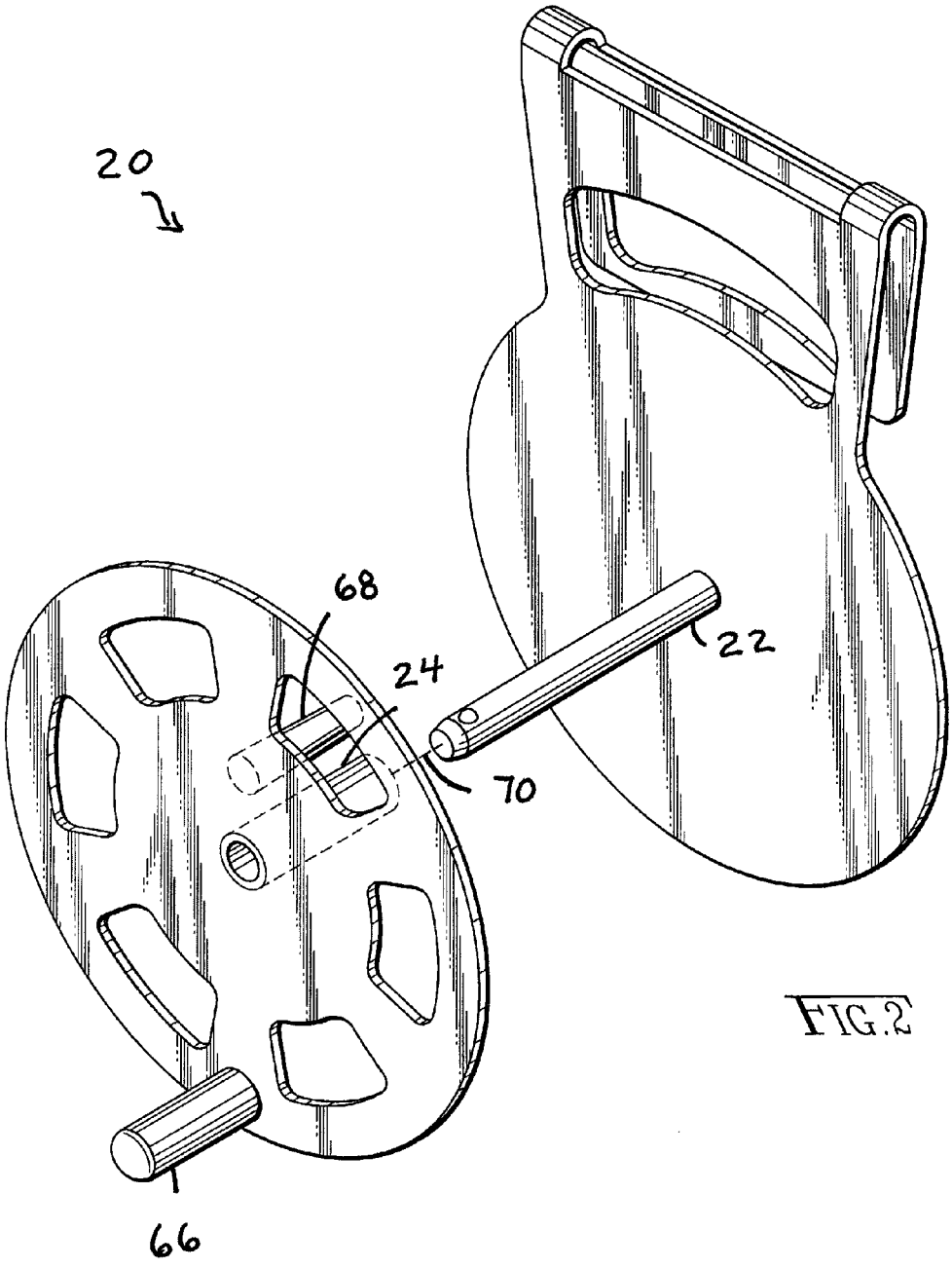
FIG. 2 is a perspective view comparable to FIG. 1 except showing the revolving side frame (ie., the driven side frame, albeit manually driven in this example) slid apart from the non-revolving (eg., stationary) side frame.
Figure 3:
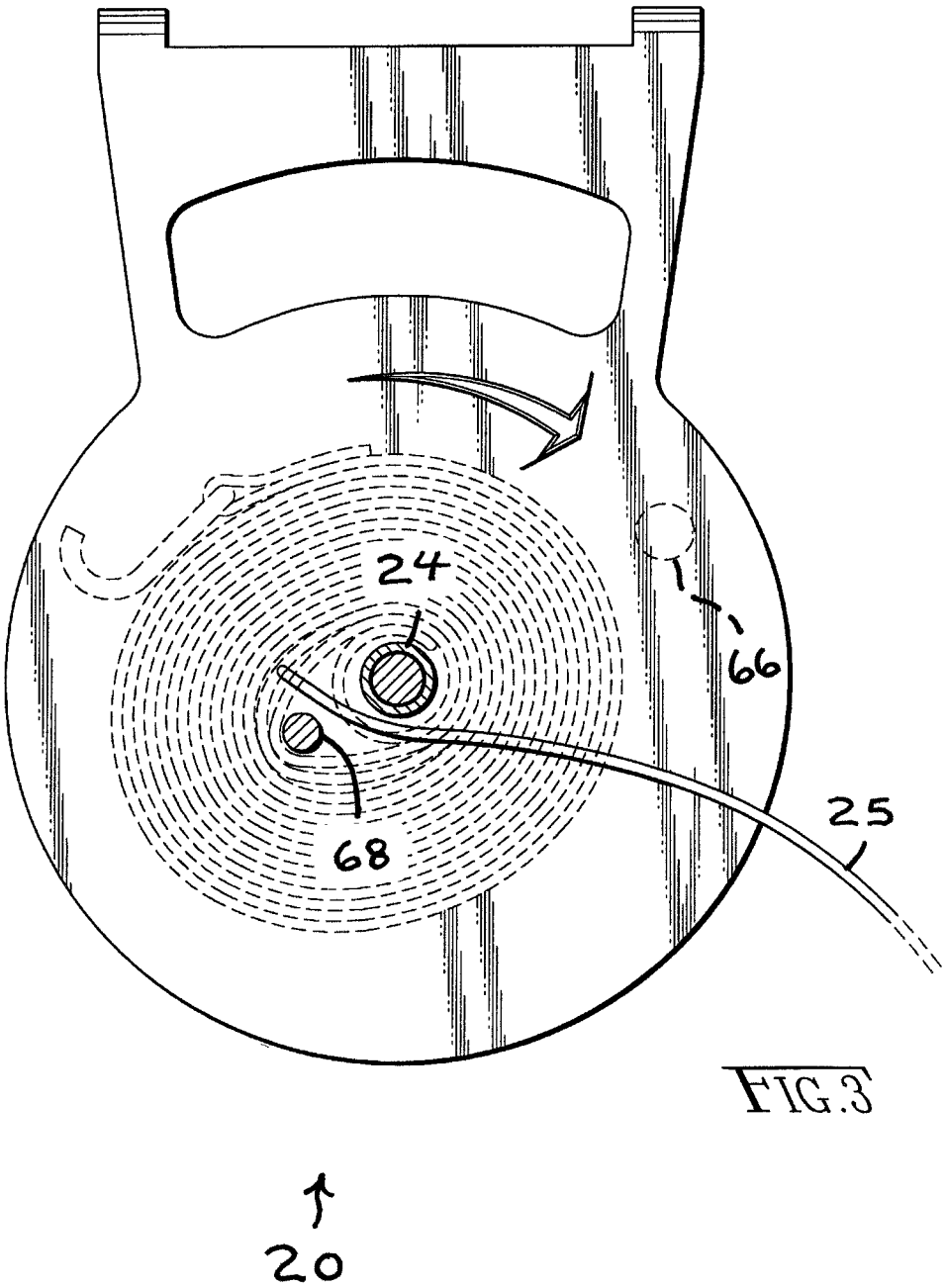
FIG. 3 is a section view taken along line in FIG. 1.

FIG. 2 shows better that the stationary side frame 32 has a central, stationary spindle stub 22. The preferred spindle stub 22 comprises a dent pin.

Staying in FIG. 2, the revolving (eg., driven) side frame 30 likewise comprises a relatively planar disk 56, preferably produced of plate steel, having inboard and outboard surfaces 62 and 64. The revolving side frame 30 has a hollow sleeve 24 or tube fixed on the central axis (eg., the axis of revolution 70) of the revolving side frame 30, and projecting away from the inboard surface 62 thereof, toward the spindle stub 22 of the stationary side frame 32. FIG. 1 shows that the stationary spindle stub 22 of the stationary side frame 32 inserts through the hollow sleeve 24 of the revolving side frame 30.

Returning to FIG. 2, the revolving side frame 30 further comprises a hand crank 66 projecting out of the outboard surface 64 thereof, and radially spaced away from the axis 70 of revolution for the spindle assembly 22,24 comprising the hollow sleeve 24 telescoped over the stationary spindle stub 22.

The revolving side frame 30 moreover comprises a pin-formed keeper 68 that projects out of the inboard surface 62 thereof. The keeper stub 68 is also radially spaced away from the axis 70 of revolution for the spindle assembly 22,24 of the hollow sleeve 24 in combination with the spindle stub 22.

It is an aspect of the invention that the hand crank 66 and keeper stub 68 have respective axes that are angularly spaced away from each other on opposite sides of the axis 70 of revolution (ie., the respective axes of the hand crank 66 and keeper stub 68 are angularly spaced away from each other 180° apart on the planar disk 56 of the revolving side frame 30).

Figure 5:
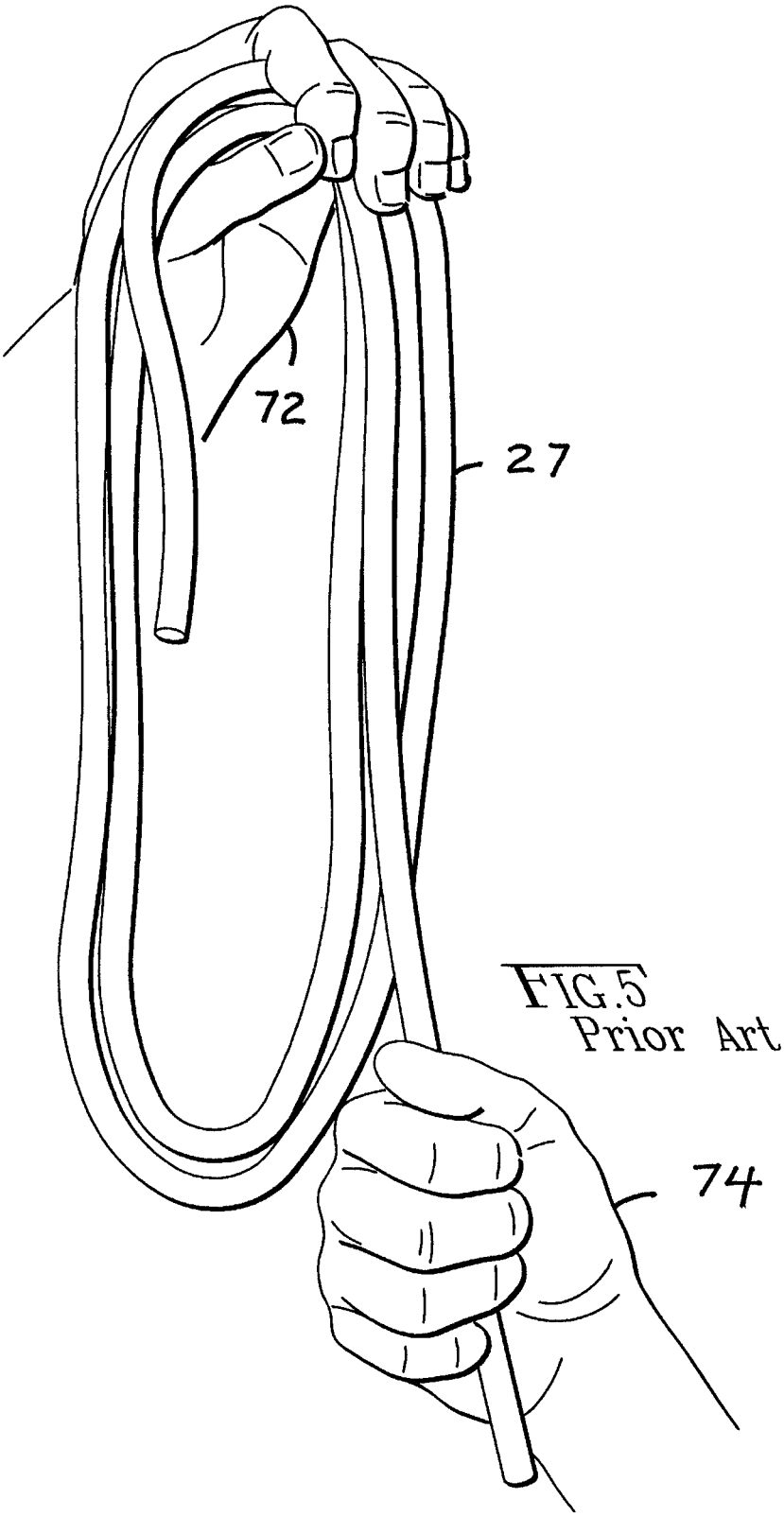
FIG.5 Prior Art
FIG. 5 is a perspective view of a rope which is coiled in accordance with one prior art way to do so.
Figure 6:
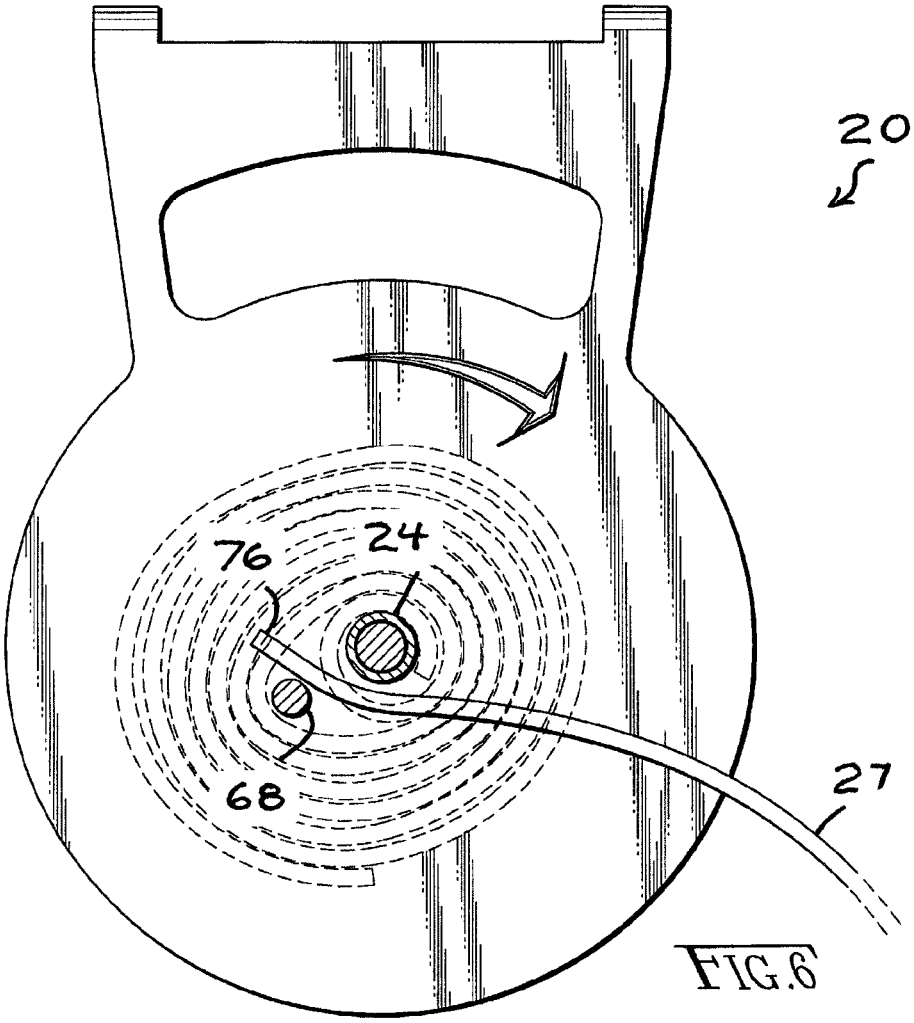
FIG. 6 is a section view comparable to FIG. 3 except showing the rope of FIG. 5 being coiled by the winding apparatus in accordance with the invention.
Figure 7:
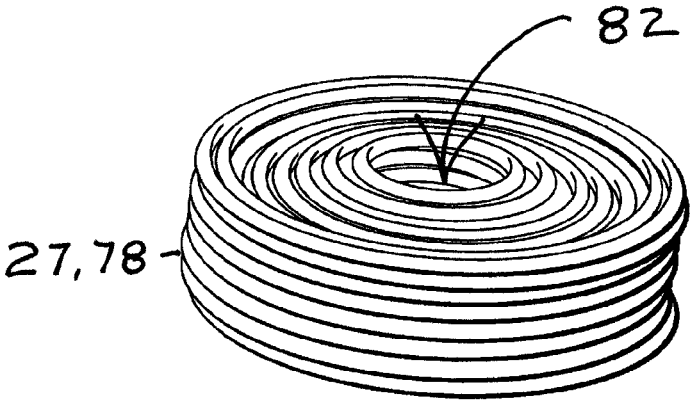
FIG. 7 shows the results of the coiling of the rope in accordance with the way shown by FIG. 6.

FIGS. 5-7 show a winding/coiling operation for a rope 27. This could be a rope 27 with a woven sheath (eg., rock climbing rope or ropes of similar construction on a reduced scale). FIG. 5 shows one prior art way of coiling rope. The user just makes coils of the rope 27 which are held in one hand 72 (ie., the holding hand 72 holds the coils in distinction to the winding hand 74). The rope 27 cannot be coiled in too tight of coils because there is a limit to just how large of an overall diameter of the bundle of coils of the rope 27 that the holding hand 72 can hold.

Other prior art ways of coiling rope include the user winding the rope 27 around the palm and triceps of one arm, with the hand 74 of the other arm doing the winding (this is not shown). Again, the rope 27 will not be wound in tight coils because the distance between a user's palm and tricep is going to be fifteen to twenty inches or so (~37 to ~51 cm).

FIG. 6 more particularly shows the winding/coiling operation of the rope 27 by the winding apparatus 20 in accordance with the invention.

The stationary side frame 32 is intended to remain relative stationary while the revolution of the revolving side frame 30 (not shown in FIG. 6) revolves the keeper stub 68 about the spindle assembly 22,24. The rope 27 has an inner tag end 76 that is fed into the gap between the spindle assembly 22,24 and the keeper stub 68. The revolving keeper stub 68 eventually produces a coil 78 of rope 27 has a width (eg., height in FIG. 7) that is the length of the outer hollow sleeve 24 (see, eg., FIG. 10). The coil 78 of rope 27 will have a central lumen 82 that will have a very minimal diameter. In other words, the coil 78 of rope 27 will be coiled more tightly by the winding apparatus 20 than can be accomplished by hand.

Preferably the stationary side frame 32 is secured by the magnet 48 or the hook provision 44. Otherwise, the holding hand 72 (as distinct from the hand 74 revolving the hand crank 66) has to hold the winding apparatus 20 by the handle formation 52. But when this hand 72 is free from having to hold the winding apparatus 20, this free hand 72 can function something like a level wind mechanism or, in other words, to feed the rope 27 onto the winding apparatus 20 to form for a more well-formed spiral coil 78.

The spiral coil 78 of the rope 27 can be removed from the winding apparatus 20 for storage all by itself by virtue that the two side frames 30 and 32 slide apart as shown by FIG. 2. The coil 78 of rope 27 initially stays with the revolving side frame 30. Then the coil 78 of rope 27 can be readily slipped off the revolving side frame 30 almost as easy as being poured off it. Thereafter, the coil 78 of rope 27 can be readily stored or stowed in a highly compact and, just as importantly, untangled form.

Once again, FIG. 2 shows that the side frames 30 and 32 can be slid apart. To look ahead to FIG. 10, there is a minimum distance the side frames 30 and 32 can be slid together. That minimum distance is likely set by the longest of the central sleeve 24 or the keeper stub 68.

It is another aspect of the invention that the keeper stub 68 is tapered from its anchor end in the inboard surface 62 of the revolving side frame 30 to its free end proximate the stationary side frame 32 in order to facilitate the sliding off of the coil 78 of rope 27 after having been wound. The keeper stub 68 offers less retention of the coil 78 of rope 27 when being slid off if the keeper stub 68 is tapered.

Figure 8:
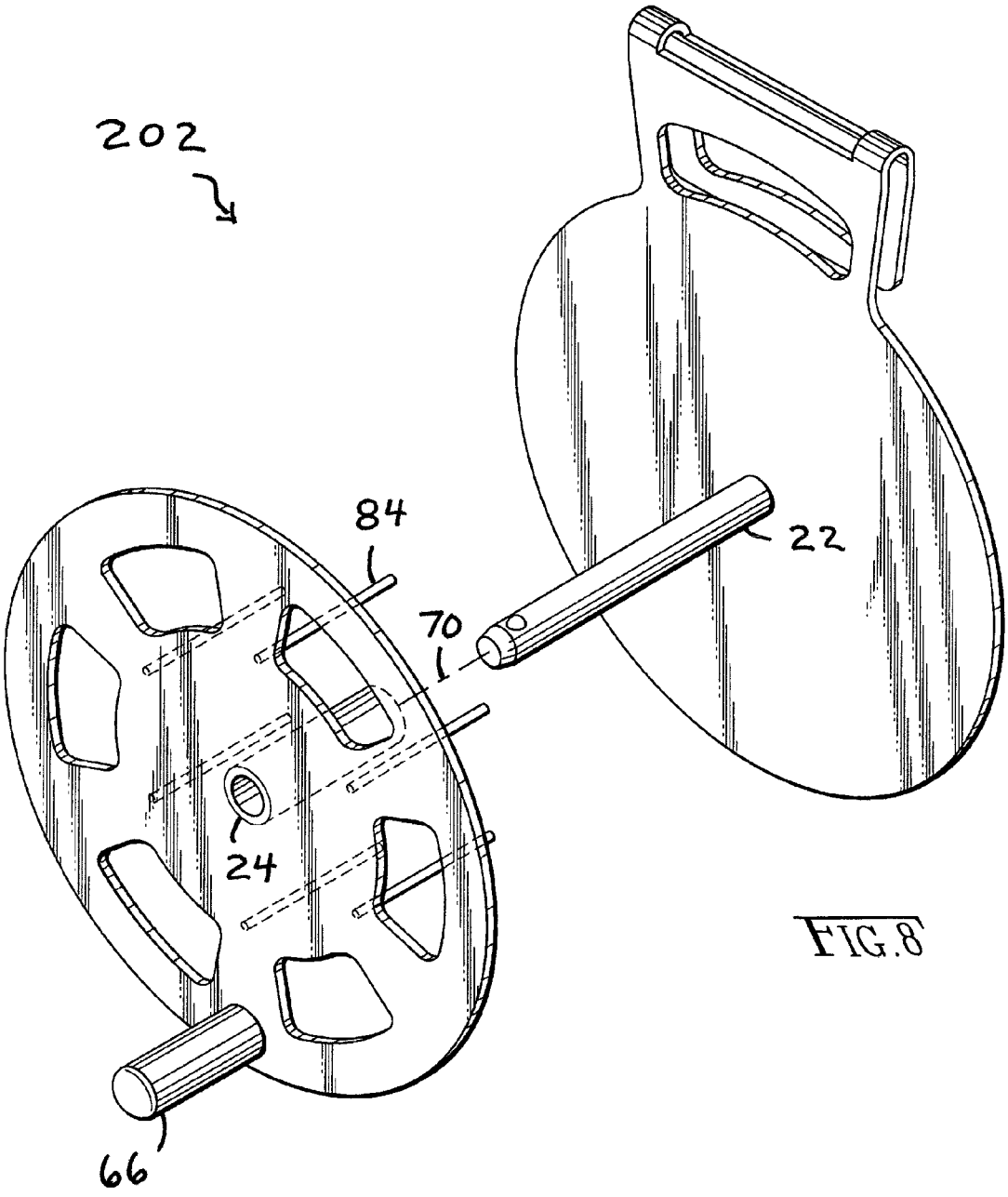
FIG. 8 is a perspective view comparable to FIG. 1 except of an alternate embodiment of winding apparatus in accordance with the invention.
Figure 9:
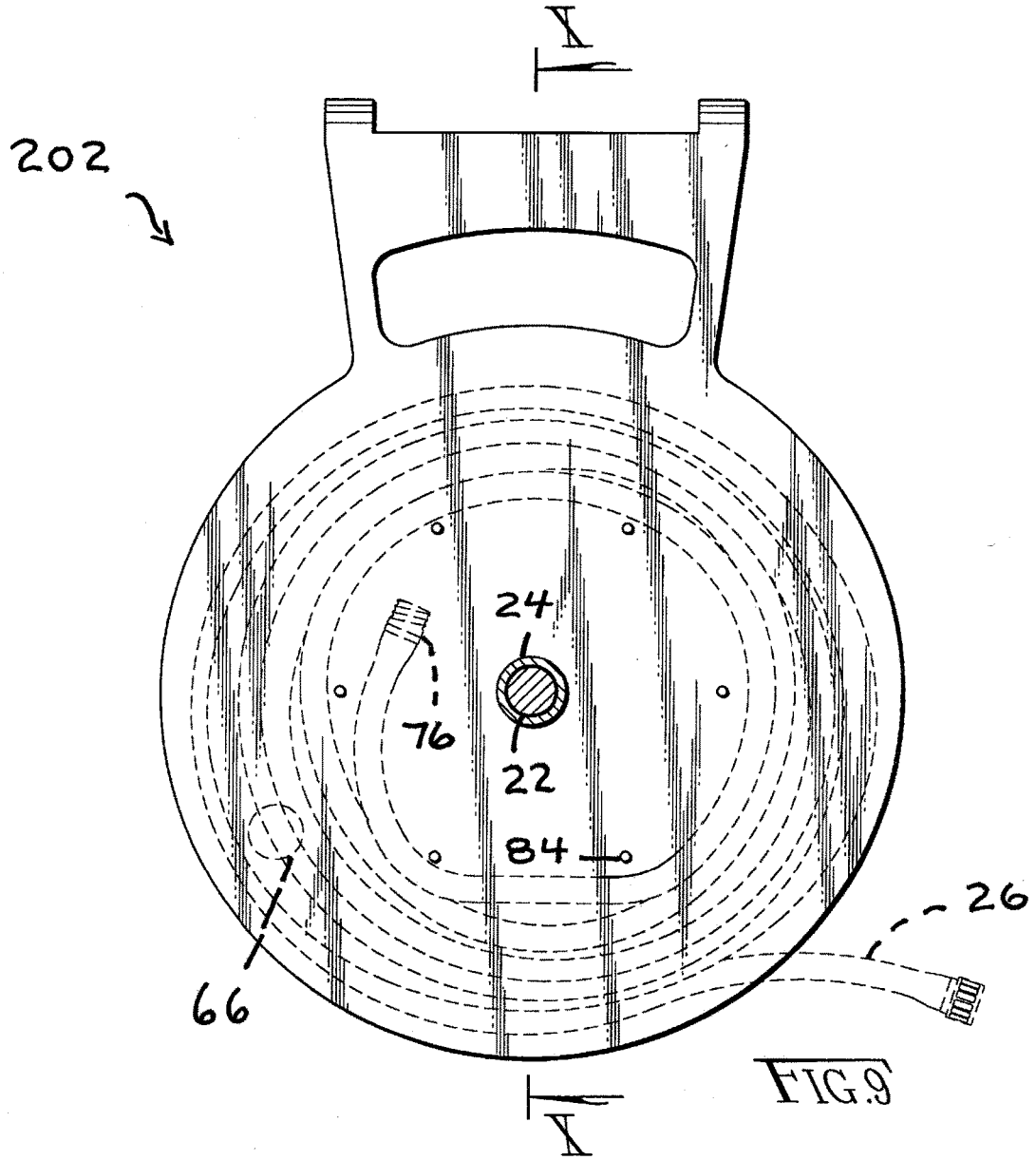
FIG. 9 is a section view comparable to FIG. 3 except showing the winding apparatus of FIG. 8 coiling a garden hose.
Figure 10:
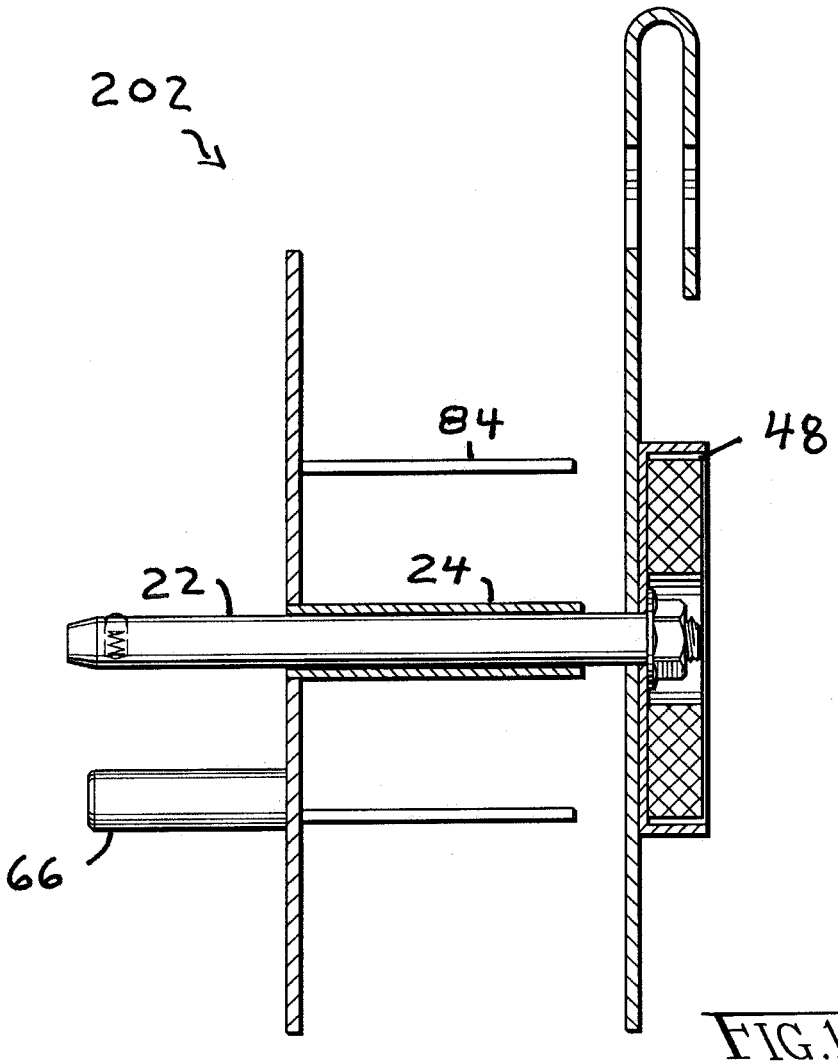
FIG. 10 is a section view taken along line X-X in FIGS. 9.

FIGS. 8-10 show an alternate embodiment of winding apparatus 202 in accordance with the invention. It is preferred to wind certain elongate flexible materials tight coils or windings as disclosed above, but also about substantial hollow lumens. The coil 78 of rope 27 shown in FIG. 7 has a virtually 'zero' radius central lumen 82. Examples of elongate flexible materials where it is preferred to have something else include without limitation garden hose 26, electric extension cords 28, strings of holiday lights 29 and so on.

In consequence, this second embodiment of the invention has a circular network of arbor spacer-pins 84 that define an essential diameter of a virtual arbor that corresponds to the diameter of the circle of the network of spacer pins 84. FIGS. 8 and 10 furthermore show that this second embodiment of the winding apparatus 202 in accordance with the invention is likewise axially adjustable.

Figure 11:
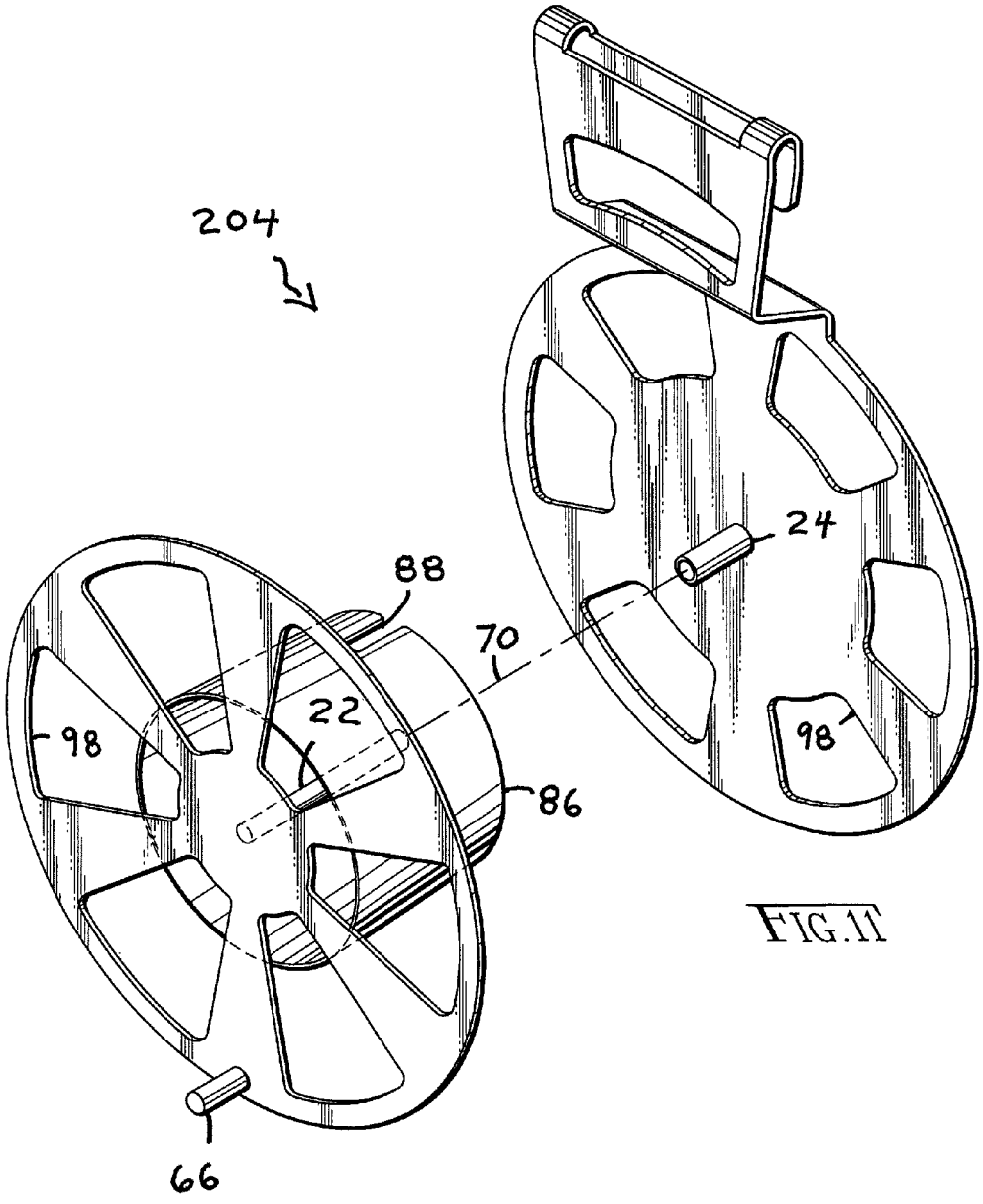
FIG. 11 is a perspective view comparable to FIGS. 1 and 8 except of a further embodiment of winding apparatus in accordance with the invention.
Figure 12:
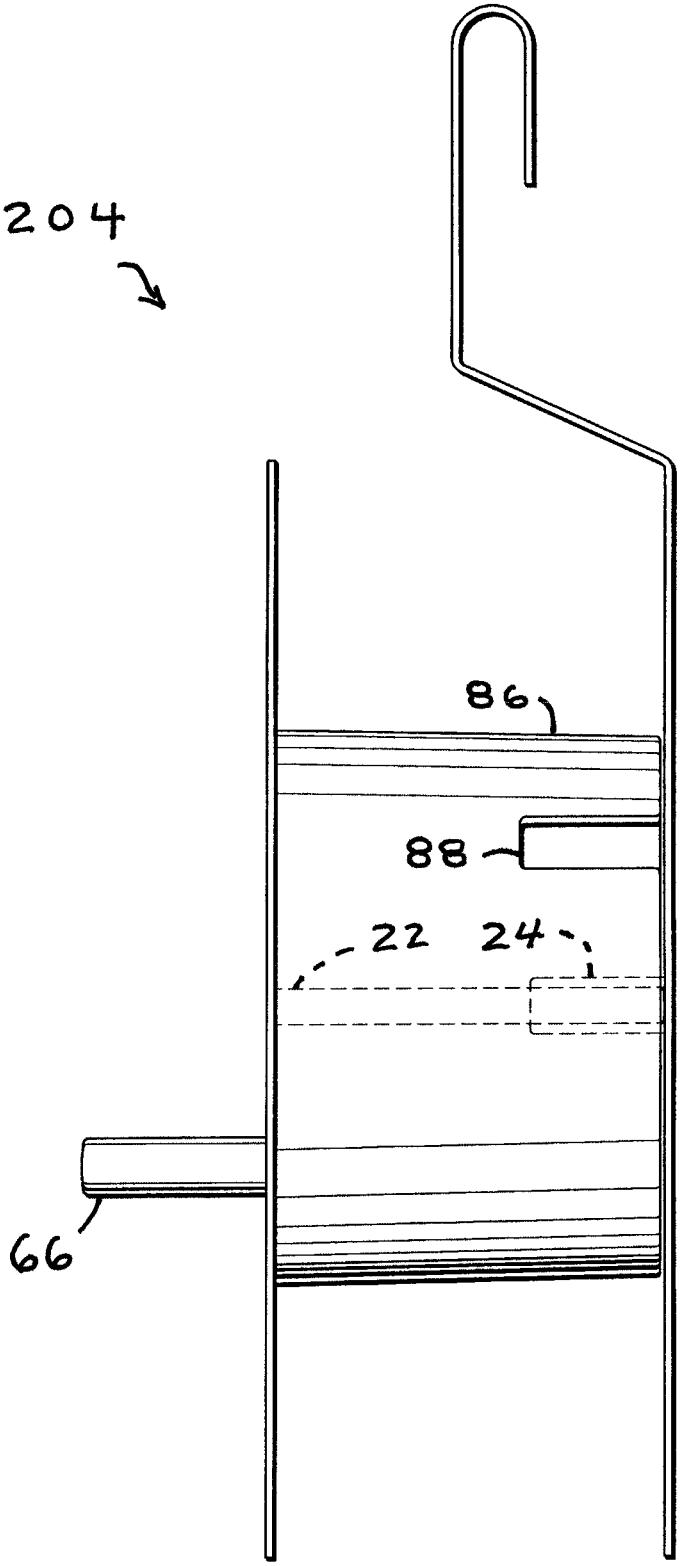
FIG. 12 is a side elevational view thereof, with the two side frames slid together.

FIGS. 11-12 show a further embodiment of winding apparatus 204 in accordance with the invention. This further embodiment of winding apparatus 204 also accommodates the preference to wind certain elongate flexible materials tight coils or windings as disclosed above, but also about substantial hollow lumens.

In this third embodiment, the winding apparatus 204 has replaced the circular network of arbor spacer-pins 84 with a slice of a conical tube 86. The tube 86 tapers in from its anchor end in the inboard surface 62 of the revolving side frame 30, to its free end proximate the stationary side frame 32. The taper promotes the removal of the coiled or wound elongate flexible material, as the case may be. The conic tube slice 86 furthermore has an open-ended slot 88 formed therein at its free end (eg., its outboard end) for the feeding in the respective tag end 76 (see FIG. 6) of the flexible elongate material which is to be wound or coiled.

Figure 13:
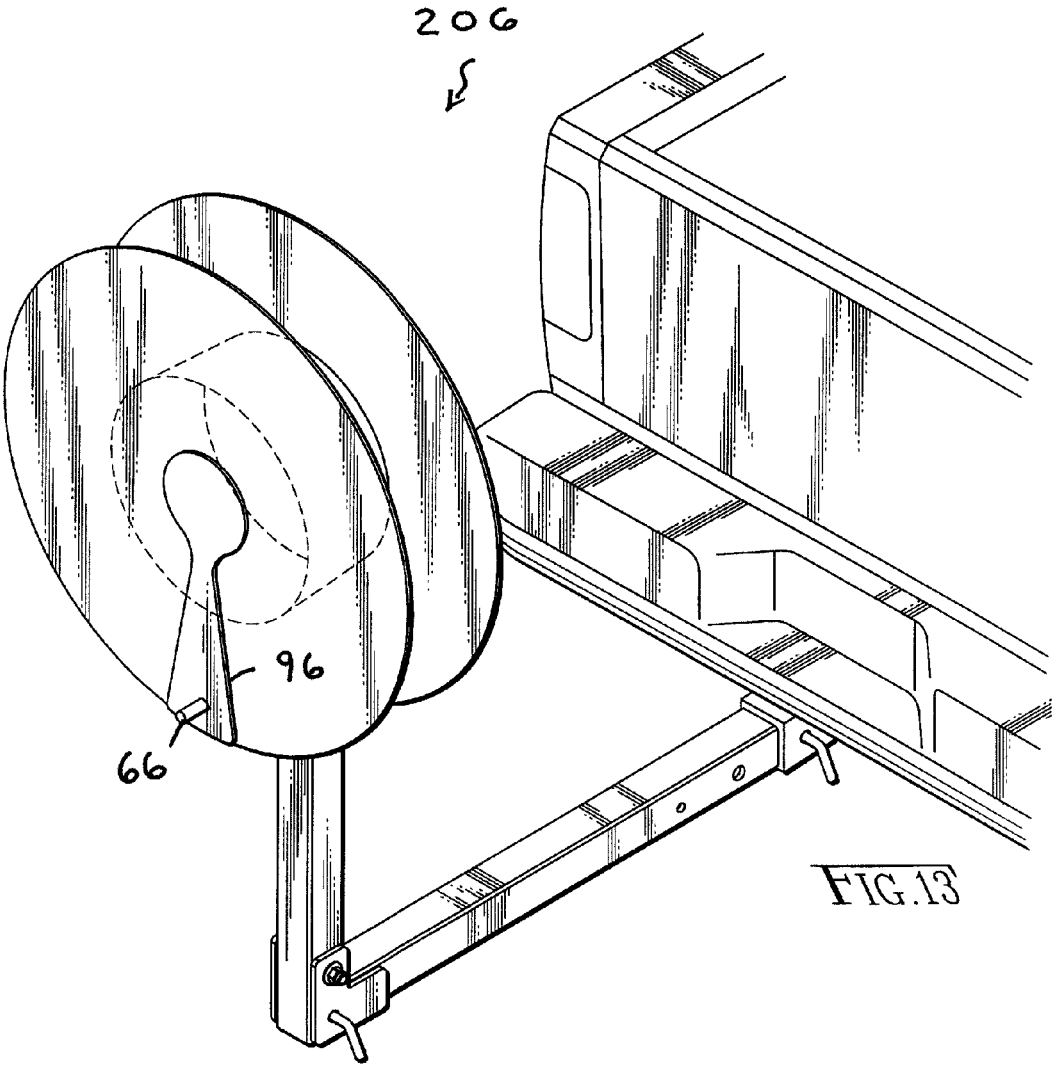
FIG. 13 is a perspective view comparable to FIGS. 1, 8 and 11 except of still another embodiment of winding apparatus in accordance with the invention.
Figure 14:
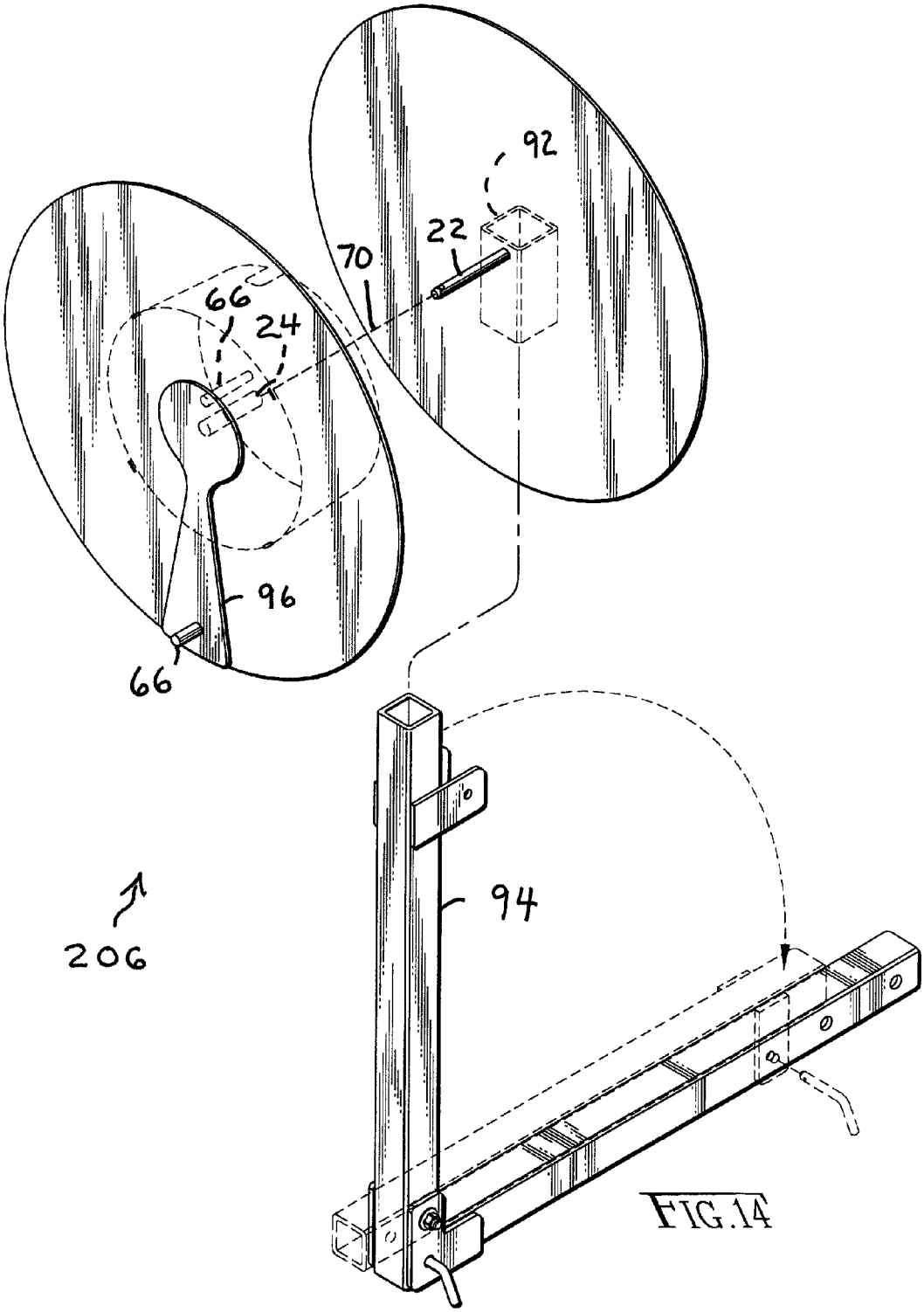
FIG. 14 is a perspective view comparable to FIG. 13 except with certain parts exploded and other parts folded up for non-use.

FIGS. 13-14 show still another embodiment of winding apparatus 206 in accordance with the invention. This winding apparatus 206 is sized on an enlarged scale. The stationary side frame 32 would likely have to carry (or withstand) a maximum weight which is probably getting too substantial to be comfortably carried or withstood by any of, a manually held handle 52, a magnet 48, or a hook 44. Therefore this winding apparatus 206 has a mounting fixture 92 for mounting to a solid mounting support structure 94.

As the relative degree of enlargement of the winding apparatus 206 increases, it is preferred to drive the revolving side frame 30 by power means (not shown). Nevertheless, if the revolving side frame 30 is going to be manually cranked, this can still be comfortably managed by spacing the hand crank 66 further away from the axis 70 of revolution. Regardless, the keeper stub 68 can be disposed relatively radially close to the spindle assembly 22,24 (and axis 70 of revolution) for elongate flexible materials that can tolerate a near 'zero' radius central lumen 82 (see FIG. 7).

However, as mentioned above, it again provides a mechanical advantage to angularly space the keeper stub 68 and hand crank 66 a half a circle apart (ie., 180° apart) relative the axis 70 of revolution.

As FIGS. 13-14 show better, as the relative size of the winding apparatus 206 gets larger, it is preferred to stiffen the connection between the distally-spaced hand crank 66 and the spindle assembly 22,24 with a separate crank arm 96. In other words, the gauge of the plate steel of the revolving side frame 30's disk 56 of the might not be strong enough to carry the torques and/or load alone across that span between the hand crank 66 and the spindle assembly 22,24 without the strengthening afforded by the crank arm 96.

As FIG. 11 shows better, it is preferred to form the revolving side frame 30 and/or the non-revolving side 32 frame as well with viewing apertures 98.

It is an aspect of the invention to make winding up elongated flexible materials more handy in the field when there is time urgency to get out of an area. Example time pressures include working along the side of highway, at a fire fight, on a ladder in winter weather during the holidays, of just before the rise of inclimate weather, and so on.

It is another aspect of the invention that elongated flexible materials are not only wound in compact windings or spiral coils, but furthermore in a pretty-much untangled form such that the winding or spiral coil unwinds into usable work material without knots or 'bird nests' and the like.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. Winding apparatus for winding a variety of elongated flexible materials into windings or spiral coils, comprising:

a pair of side frames, each comprising a generally circular main central portion, said main central portions having inboard surfaces facing each other and outboard surfaces facing away;

an axially-adjustable spindle assembly comprising a hollow tubular sleeve and a generally cylindrical spindle stub, wherein one side frame has the hollow tubular sleeve affixed thereto and extending away from about the center of the inboard surface while the other side frame has the cylindrical spindle stub affixed thereto and extending away from about the center of the respective inboard surface of said other side frame;

wherein said spindle stub telescopes into the tubular sleeve such that the side frames can revolve/rotate relative each other, close the gap between each other, and pull apart.

2. The winding apparatus of claim 1, wherein:

said hollow tubular sleeve is open through the outboard surface of said one side frame which said hollow tubular sleeve is affixed thereto.

3. The winding apparatus of claim 2, wherein:

said side frames can only close the gap between each other by the length between the free end of the hollow tubular sleeve and the inboard surface of said one side frame which said hollow tubular sleeve is affixed thereto.

4. The winding apparatus of claim 3, wherein:

said spindle stub is significantly longer than the hollow tubular sleeve.

5. The winding apparatus of claim 4, further comprising:

said spindle stub comprises a dent pin.

6. The winding apparatus of claim 1, further comprising:

a keeper provision affixed to and extending away from the inboard surface of one or the other side frames, whereby the tag end of the elongated flexible material to be wound or coiled is fed into the keeper provision or fed between the keeper provision and the axially-adjustable spindle assembly.

7. The winding apparatus of claim 6, wherein:

the keeper provision comprises a pin radially spaced away from the axially-adjustable spindle assembly.

8. The winding apparatus of claim 7, wherein:

the keeper pin has a length between the free end thereof and the inboard surface of the side frame to which said keeper pin extends from;

the hollow tubular sleeve pin has a length between the free end thereof and the inboard surface of the side frame to which said hollow tubular sleeve extends from; and the two lengths are generally about equal to each other.

9. The winding apparatus of claim 7, wherein:

the keeper pin has a length between the free end thereof and the inboard surface of the side frame to which said keeper pin extends from; and the keeper pin is tapered to be thinner at the free end whereby after the elongated flexible material is wound or coiled, and the side frames are pulled apart, the winding or coil can be essentially poured of the side frame with the keeper pin because of the taper.

10. The winding apparatus of claim 7, further comprising:

a hand crank attached to and extending away from the outboard surface of one or the other side frames and radially spaced away from the axially-adjustable spindle assembly;

wherein said hand crank and said keeper pin are angularly spaced apart relative to the axially-adjustable spindle assembly by 180°.

11. The winding apparatus of claim 6, wherein:

the keeper provision comprises a slice of conic tube extending between a narrower free end and a wider anchored end extending from the inboard surface of one or the other side frames and disposed co-axially surrounding the axially-adjustable spindle assembly.

12. The winding apparatus of claim 11, wherein:

said slice of a conic tuber is formed with an open-ended slot in the free end thereof for feeding the tag end therein of the flexible elongated material to be wound or coiled.

13. The winding apparatus of claim 6, wherein:

the keeper provision comprises a circular network of arbor spacer-pins extending between free ends and base ends based in the inboard surface of one or the other side frames, and disposed co-axially surrounding the axially-adjustable spindle assembly.

14. The winding apparatus of claim 1, wherein:

one or the other of the side frames is a relatively stationary side frame; and said relatively stationary side frame comprises a handle provision for being manually held by a user during coiling or winding operations.

15. The winding apparatus of claim 14, wherein:

the handle provision projects radially beyond the diameter of the rest of the periphery of the main central portion of said relatively stationary side frame.

16. The winding apparatus of claim 1, wherein:

one or the other of the side frames is a relatively stationary side frame; and said relatively stationary side frame comprises a magnet on the outboard surface thereof for mounting said winding apparatus to a ferromagnetic material mounting surface during coiling or winding operations.

17. The winding apparatus of claim 16, wherein:

said mounting surface is a generally vertical surface of a work vehicle.

18. The winding apparatus of claim 1, wherein:

one or the other of the side frames is a relatively stationary side frame; and said relatively stationary side frame comprises a hook provision protruding radially beyond the diameter of the rest of the periphery of the main central portion of said relatively stationary side frame for hooking said winding apparatus over a hooking support structure during coiling or winding operations.

19. The winding apparatus of claim 18, wherein:

said hooking support structure is a generally vertical panel of a work vehicle.

20. The winding apparatus of claim 1, wherein:

one or the other of the side frames is a relatively stationary side frame; and said relatively stationary side frame comprises a mounting fixture for removable mounting of said winding apparatus to a support structure during coiling or winding operations.

* * * * *